US005823172A

United States Patent [19]

Suggitt

[11] Patent Number: 5,823,172

[45] Date of Patent: Oct. 20, 1998

[54] CROSSBOW BOW STRING DRAWING DEVICE

[76] Inventor: Jack A. Suggitt, 626 Osband, Ypsilanti, Mich. 48198

[21] Appl. No.: 791,481

[22] Filed: Jan. 27, 1997

Related U.S. Application Data

[63] Continuation-in-part of Ser. No. 533,267, Sep. 25, 1995, abandoned.

[51] Int. Cl.[6] ..... F41B 5/12

[52] U.S. Cl. ..... 124/25

[58] Field of Search ..... 124/25, 86; 254/111

[56] References Cited

U.S. PATENT DOCUMENTS

| | | | |
|---|---|---|---|
| 1,121,507 | 12/1914 | Kapferer | 254/111 |
| 3,043,287 | 7/1962 | Nelson | 124/25 |
| 4,593,675 | 6/1986 | Waiser | 124/25 |
| 4,603,676 | 8/1986 | Luoma | 124/25 |
| 4,649,892 | 3/1987 | Bozek | 124/25 |
| 4,697,571 | 10/1987 | Waiser | 124/25 |
| 4,942,861 | 7/1990 | Bozek | 124/25 |
| 5,115,795 | 5/1992 | Farris | 124/86 |
| 5,220,906 | 6/1993 | Choma | 124/25 |

*Primary Examiner*—John A. Ricci
*Attorney, Agent, or Firm*—Young & Basile, P.C.

[57] ABSTRACT

A device to draw the bow string of a crossbow is disclosed, comprising a housing and an elongate arm both extendable from and rectilinearly moveable with respect to the housing in at least one direction coaxial with the longitudinal axis of the arm. A drive mechanism is provided in mechanical communication with the arm, such that operation of the drive mechanism effects rectilinear movement of the arm in the at least one direction with respect to the housing. The arm is further provided with a fork for engaging the crossbow bow string. For crossbows of the type including a longitudinal barrel having a recessed track therein, an aligning pin is provided, the aligning pin slidingly receivable within the crossbow track such that the path of travel of the arm is substantially parallel to the longitudinal axis of the track.

28 Claims, 6 Drawing Sheets

FIG-2
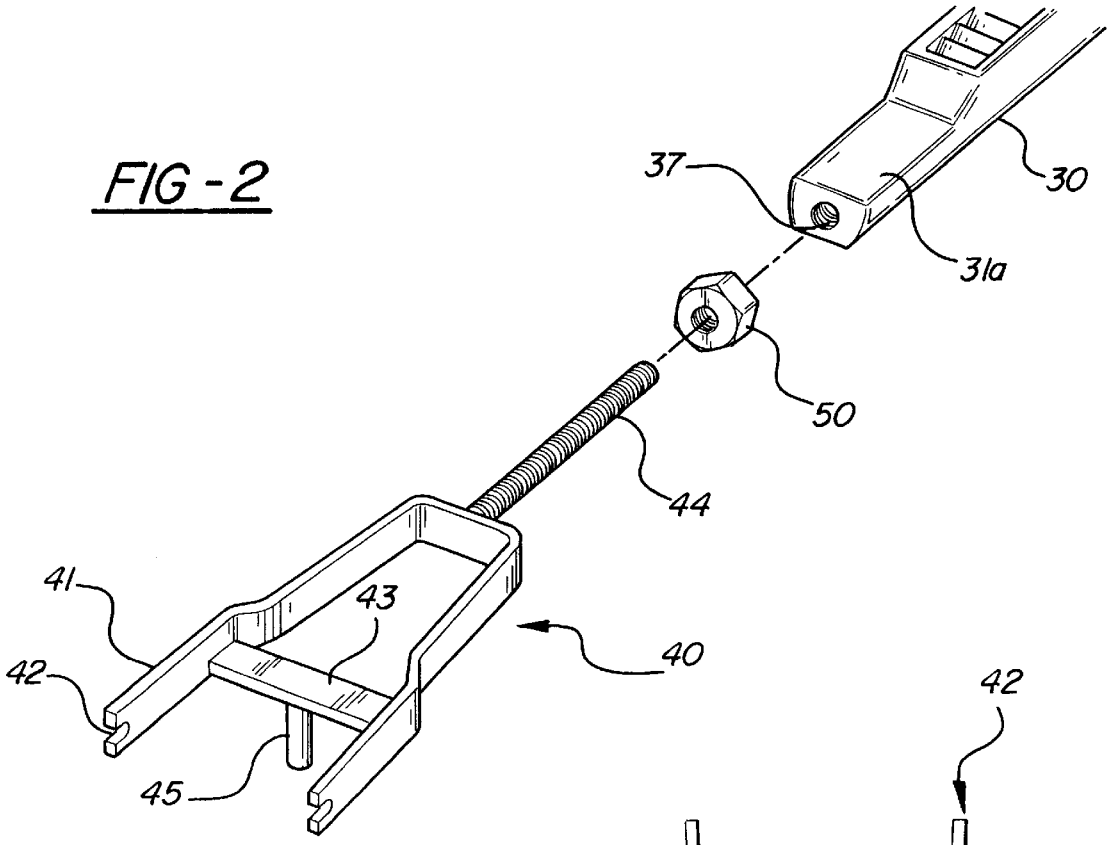
FIG-2A
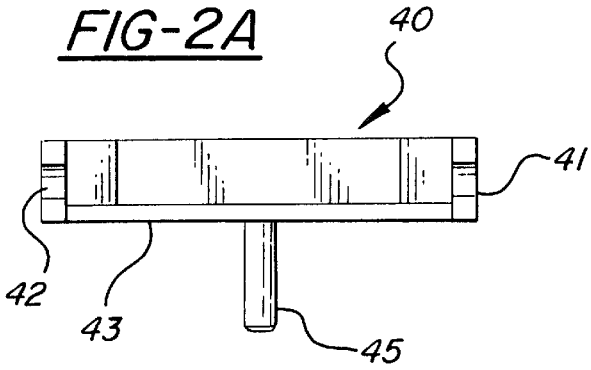
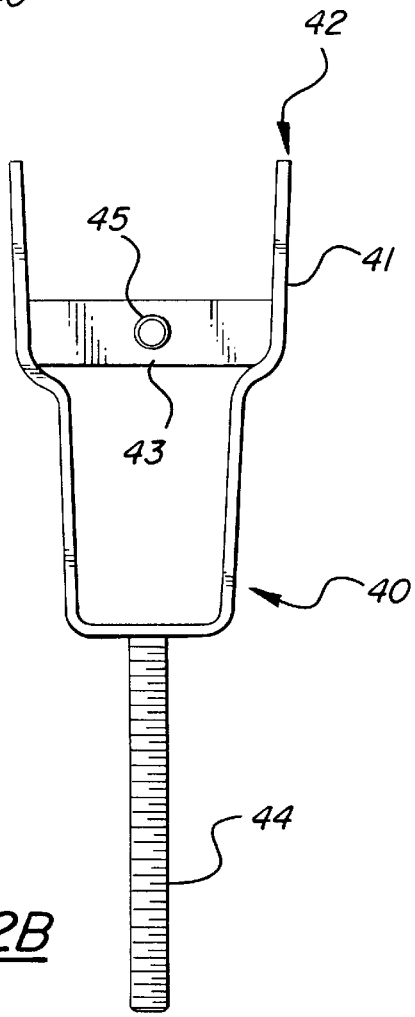
FIG-2B

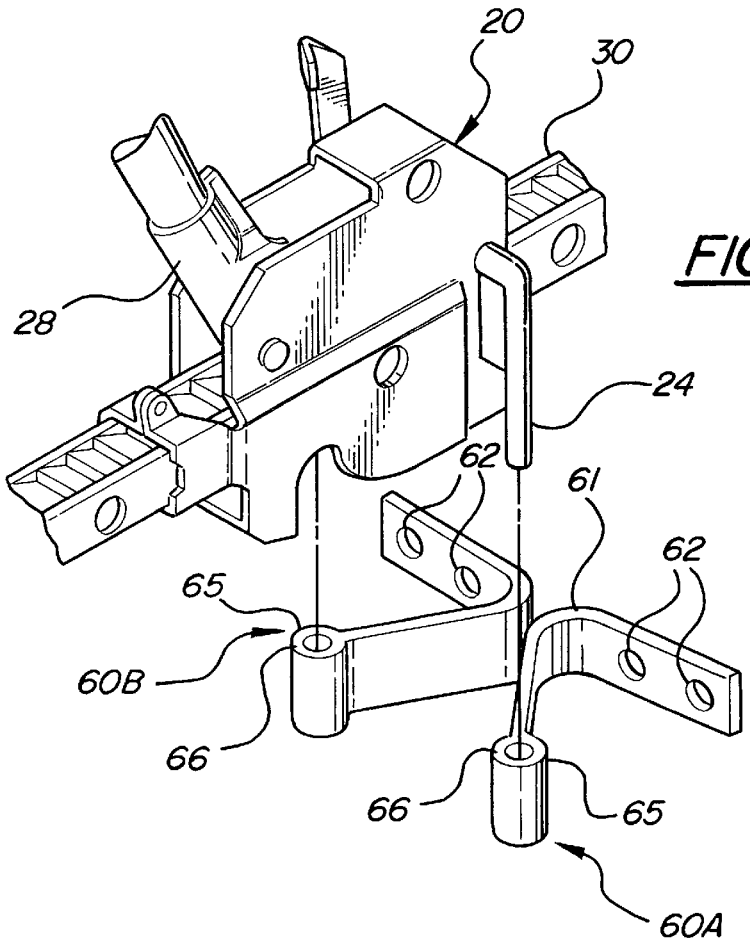
FIG-3
FIG-4
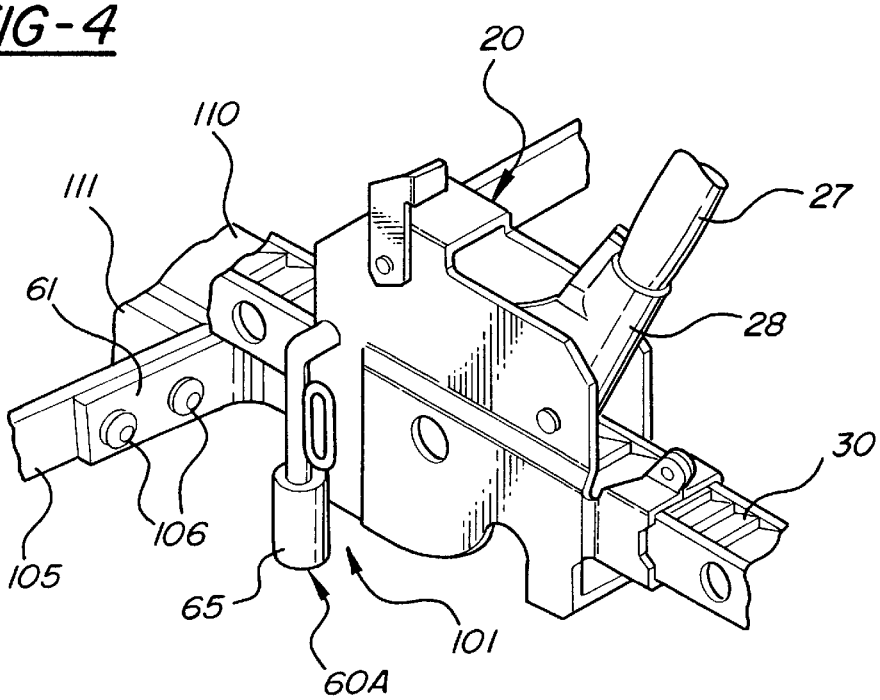

CROSSBOW BOW STRING DRAWING DEVICE

This application is a continuation-in-part of the application Ser. No. 08/533,267, filed Sep. 25, 1995 now abandoned.

FIELD OF THE INVENTION

The present invention relates generally to crossbow bow string drawing devices and particularly to a manually operable device for drawing the bow string of a crossbow of the type including a longitudinal barrel having a recessed track therein.

The device is removably engageable with the crossbow and includes an arm rectilinearly moveable in at least a first direction coaxial with its own longitudinal axis, the arm being mechanically driven by a hand lever. Means are provided at one end of the arm for engaging the bow string such that movement of the arm—through operation of the hand lever—will force the bow string into the drawn position. Further provided are aligning means slidingly engageable with the track such that the path of travel of the arm is substantially parallel to the longitudinal axis of the track.

BACKGROUND ART

A crossbow typically comprises both a stock and a riser portion which includes a barrel or track wherein the arrow (more commonly referred to as a bolt) is placed prior to firing. At one end of this assemblage is the bow portion, which in modern crossbows includes separate opposing, transversely-extending, arcuate limbs. The string runs over the barrel between the ends of both limbs, such that drawing the string forces each limb into a flexed position of extreme tension and potential energy. For this reason, the act of drawing the bow string requires great physical exertion.

It is commonplace in modern crossbows that the bow string tension be compounded. This is achieved by a bow string which actually comprises several strings connected both to each other as well as the limbs of the bow via a set of pulleys. The benefit of compounding is that it increases the force with which a bolt is fired. Unfortunately, an added result of compounding is that the draw weight—the amount of force which must be applied to bring the bow string from its relaxed position into its drawn position—is raised to around 150 lbs.

As a general rule, it is extremely difficult for a person of average physical strength to draw unaided a bow string requiring 150 lbs. of force, even though most crossbows are provided with a foot stirrup at one end thereof to increase the leverage which can be applied against this force. These limitations notwithstanding, some states have by statute restricted the use of crossbows for hunting purposes to individuals with documented physical handicaps. Not surprisingly, drawing unaided a modern compound crossbow is virtually impossible for these persons.

Several and varied solutions to the problem of drawing a crossbow have been presented by the prior art, some of which augment an individual's physical strength. According to one such solution, a lever arm is provided which is removably attached to the forward end of the bow. Pivotally connected to this lever arm and extending at an acute angle therefrom is a second arm engageable at its free end with the bow string. As the lever arm is depressed towards the crossbow body, the second arm is correspondingly forced towards the rear of the crossbow. This action results in the bow string being driven into the drawn position. A second force-augmenting prior art device comprises a length of rope or chord with handles provided at either end thereof. Two hooks are moveably disposed along the rope between the handles. In operation, the center of the rope is laid over the butt of the crossbow stock such that equal lengths of rope drape freely on either side thereof. Each hook is subsequently attached to a segment of the bow string on either side of the stock. By then manually pulling the handles towards the butt end of the bow, the string is pulled into the drawn position.

Finally, Choma, U.S. Pat. No. 5,220,906, discloses an electrically operable, battery-powered device according to which a movable shaft is driven between retracted and extended positions with respect to a housing removably connected to the front end of a crossbow. The shaft includes at the free end thereof a fork which engages and draws the bow string as the shaft is driven into the extended position.

Of the manually operable prior art devices, none provide a sufficient mechanical advantage to effectively reduce the physical exertion required to overcome the 150 lb. draw weight of a compound crossbow, particularly for individuals having physical handicaps. Neither do these devices permit an individual user to safely disengage the bow string from its drawn position. Instead, a drawn bow must be cocked and fired; an action which may be damaging to either or both of the crossbow and the bolt. And while the device of Choma does enable relatively effortless drawing and relaxing of the bow string, the complexity of the electrically-operated drive mechanism makes the device both expensive to manufacture and subject to breakdown. Moreover, the Choma device is prone to power loss due to degeneration of the battery through repeated use. Though the commercial embodiment of this device includes recharging means, this does not overcome the problems associated with power failure occurring when the bow string is between the drawn and relaxed positions. In such instances, there is simply no way of safely releasing the bow string. Moreover, these prior art devices are prone to develop unwanted lateral play in the device during drawing of the bow string. As a consequence of such play, the bow string is cocked in a state of unequal tension on either side of the crossbow body. This results in inaccurate crossbow shooting performance.

SUMMARY OF THE PRESENT INVENTION

Accordingly, it is an object of the present invention to provide a device for the relatively effortless drawing of a bow string through simple, manually operable mechanical means.

It is a further object of the present invention to provide for a bow string drawing device wherein the bow string may be effortlessly drawn and disengaged by an individual user.

It is still a further object of the present invention to provide for a bow string drawing device wherein the bow string may be drawn with a uniform tension on either side of the crossbow stock.

These and other objects of this invention are accomplished according to a bow-string drawing device for use in connection with a crossbow of the type including a recessed track therein. The device comprises a housing having an elongate arm extendable therefrom. The arm has first and second ends and is rectilinearly movable with respect to the housing in at least one direction coaxial with the longitudinal axis of the arm. The arm further includes means for engaging the crossbow bow string, as well as aligning means slidingly receivable within the track of the crossbow such that the path of travel of the arm is substantially parallel to the longitudinal axis of the track.

According to another feature of the present invention, the aligning means comprise a pin. According to still another feature of this invention, the means for engaging the crossbow bow string comprise a fork having spaced-apart tines, and a reinforcing bar securely retaining the tines in a fixed position with respect to each other. The fork may be selectively longitudinally extendable and longitudinally retractable with respect to the arm, in order that the present invention may be adjusted to accommodate crossbows with a variety of barrel lengths. Also according to this feature, the pin projects from the reinforcing bar.

According to one feature of the present invention, the arm may further include a plurality of holes therein in order to decrease the overall weight of this inventive device. The first end of the arm may also include a cut-out portion oriented towards both the first end and the upper surface of the arm. The cut-out portion prevents interference between the first end of the arm and various hardware appended to the crossbow, for example, a telescopic sight, during operation of the present invention.

According to yet another feature of the present invention, the device includes a manually operable lever provided on the housing, and teeth provided on the arm. A drive mechanism is also provided by which the lever is in mechanical communication with the teeth, such that operation of the lever effects rectilinear movement of the arm in the at least one direction with respect to the housing. The drive mechanism may further be selectively adjustable, such that operation of the drive mechanism will cause rectilinear movement of the arm in either of two directions, thereby permitting the crossbow bow string to be drawn or disengaged as desired. According to one feature of the present invention, the drive mechanism comprises ratchet means and the teeth define grooves arranged seriatim along the longitudinal axis of the arm.

According to these and other embodiments disclosed herein, the inventive crossbow bow string drawing device enables even an individual user having physical limitations to manually draw or disengage a crossbow bow string both safely and easily.

BRIEF DESCRIPTION OF THE FIGURES

FIG. 2 is a detailed perspective view of the means for engaging the bow string and the aligning means of the present invention;

FIG. 2A is a frontal view of the means for engaging the bow string and the aligning means of the present invention;

FIG. 2B is a bottom view of the means for engaging the bow string and the aligning means of the present invention;

FIG. 3 is a detailed elevation of the mounting elements employed in the present invention;

FIG. 4 is a detailed elevation of the mounting elements of the present invention in functional engagement with a crossbow;

DETAILED DESCRIPTION OF THE ILLUSTRATED EMBODIMENT

Figure 1A:
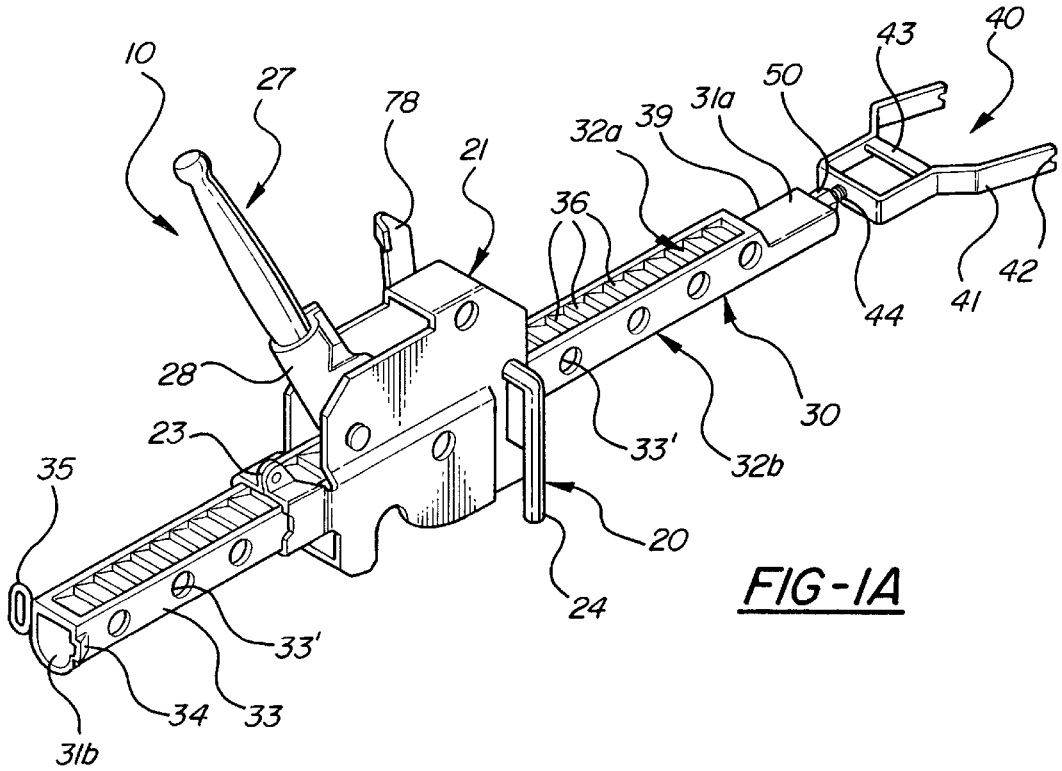
FIG. 1A is a right-side perspective view of the present invention.
Figure 1B:
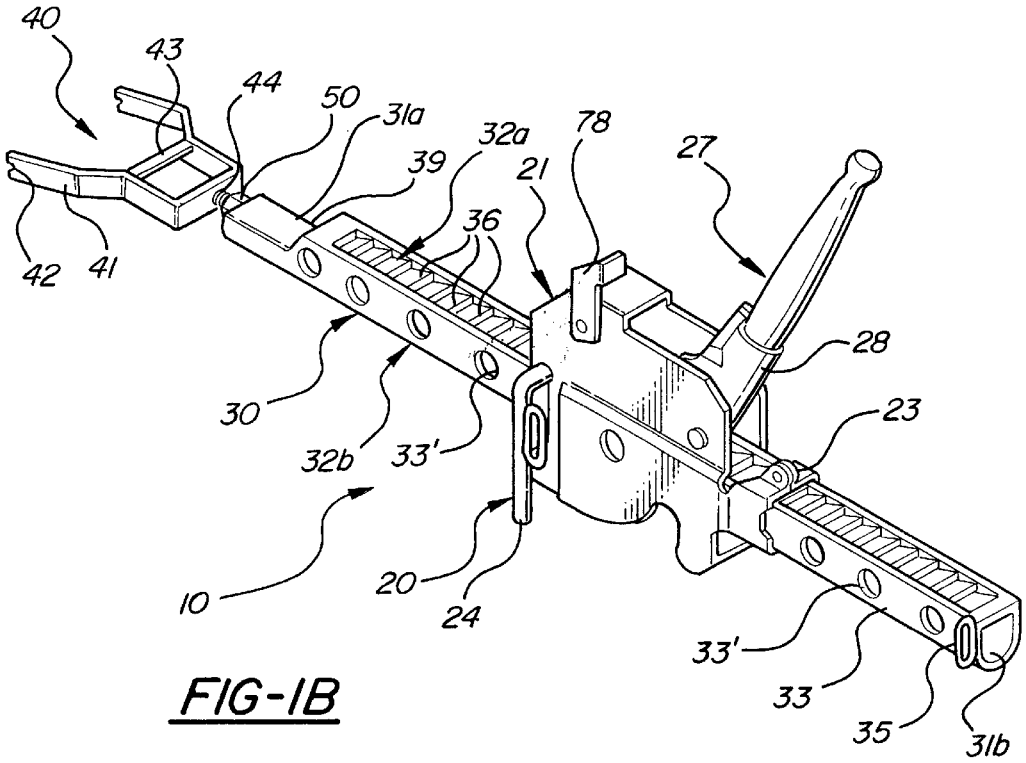
FIG. 1B is a left-side perspective view of the present invention.
Figure 5A:
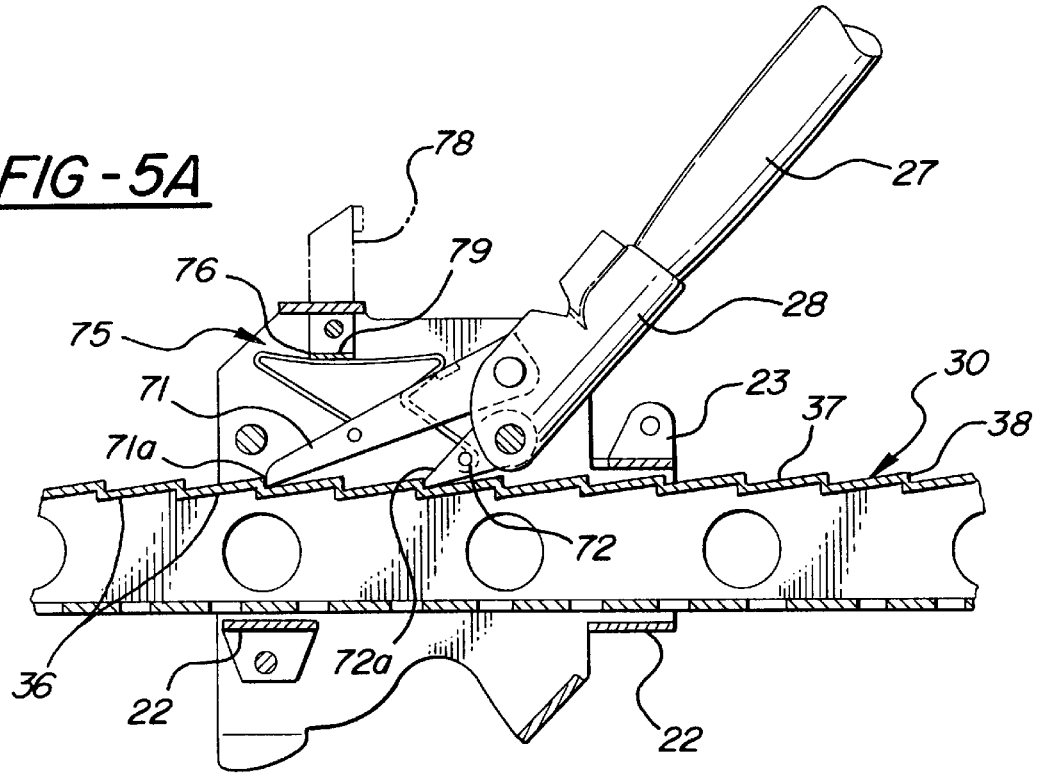
FIG. 5A is a lateral cross-section detailing the forward drive mechanism of the present invention.

Referring now to the drawings, the device 10 of the present invention is designed to be a man-portable crossbow bow-string drawing device which is operable by an individual user. As shown in FIGS. 1A and 1B, device 10 generally comprises a hollow housing 20 including a hand lever 27 pivotally disposed thereon, and an elongate arm 30 having first 31*a* and second 31*b* ends. Elongate arm 30 extends through passageway 21 provided in housing 20 and is rectilinearly moveable with respect to housing 20 in at least a first direction coaxial with the longitudinal axis of the arm. In the most preferred embodiment, explained in greater detail herein, arm 30 is rectilinearly moveable in two directions, comprising forward and reverse movement thereof. Guide platforms 22 in the interior of housing 20 both partially define passageway 21 and securely retain the arm in its rectilinear position. (FIG. 5A.) First end 31*a* of arm 30 further includes means for engaging the crossbow bow string. According to the illustrated form, both housing 20 and second end 31*b* of arm 30 are provided with means for securely engaging a shoulder harness or strap (not shown), in order that the device 10 might be more easily portable. Such means comprise eyelets or loops 25, 35 affixed to each of the housing 20 and arm 30, respectively, the shoulder harness disposed therebetween.

Still referring to FIGS. 1A and 1B, housing 20 is preferably manufactured from metal, ABS plastic, fiberglass, or some equivalently strong material. Hand lever 30, the function of which is described in greater detail herein, is pivotally connected to housing 20 and projects upwardly therefrom. Fin 23, disposed immediately behind hand lever 27, prevents the excessive rearward movement of the hand lever during operation thereof. Projecting vertically downward from each side of housing 20 are rigid pins 24 whose function is also described more completely below. As shown, pins 24 may be formed integral with the housing to increase their strength.

Arm 30 preferably comprises a hollow, elongate beam having spaced-apart first 31*a* and second 31*b* ends, as well as lateral surfaces 33, lower surface 32*b*, and an upper surface 32*a* on which is provided a plurality of teeth 36. The length of arm 30 may be varied, depending upon the size of the crossbow with which it is to be used. Preferably, the length of arm 30 is between 24 and 36 inches, in order to accommodate a variety of crossbow barrel lengths. Of course, the minimum preferred length is such as to allow the device to be detachably engaged with the front end of a crossbow, while simultaneously permitting arm 30 to extend sufficiently far so that the bow string to be both drawn and cocked. In the preferred form, an outwardly projecting detent 34 is also disposed on one of lateral surfaces 33. When arm 30 is fully extended in the forward direction, detent 34 abuts the rear surface of housing 20, thus preventing unwanted over-extension of the arm. Opposing lateral surfaces 33 and lower surface 32*b* are further characterized by a number of holes 33' which are preferable simply for decreasing the overall weight of device 10. As shown, holes 33' are equidistant in order to simultaneously preserve the structural integrity of arm 30. However, one skilled in the art will appreciate that the frequency and/or size of holes 33' will vary depending on both the length of arm 30, as well as the material from which it is fabricated. Front end 31*a* of arm 30 is characterized by a narrower lateral profile comprising cut-out portion 39, which is oriented so as to open towards both front end 31*a* and upper surface 32 of the arm. The function of this cut-out portion 39 is explained in greater detail herein. Disposed at front end 31*a* of arm 30 are means for engaging the bow string comprising, as shown, a bow string fork 40 having parallel, spaced-apart tines 41. At the end of each tine 41 is provided a notch 42 of sufficient size and depth to securely but releasingly accommodate a bow string during operation of this inventive device. (FIGS. 2, 2A, and 2B.) In the illustrated form, fork 40 is substantially "U"-shaped unitary structure of metal or polymer; the distance between each of the tines 41 being about 2 inches in order to avoid interference between fork 40 and the crossbow's bow string cocking mechanism (not shown). A horizontally oriented reinforcing bar 43 connects tines 41, preventing the unwanted lateral separation thereof during use. Threaded shaft 44 provides the mounting connection between fork 40 and arm 30; a correspondingly threaded bore 37 being provided in arm 30 for receiving shaft 44 therein. Bolt 50 provides for secure engagement between shaft 44 and arm 30. In the most preferred form, threaded shaft 44 is several inches in length and may be selectively extended away from or retracted into arm 30, for reasons explained herein.

Still referring to FIGS. 2, 2A, and 2B, the present invention also preferably includes aligning means slidingly receivable within track 112 of crossbow 100 (shown in FIG. 6) such that the path of travel of arm 30 is substantially parallel to the longitudinal axis of track 112. As shown, aligning means may take the form of a pin 45 depending substantially perpendicularly from reinforcing bar 43 of fork 40. Pin 45 may be formed integrally with reinforcing bar 43, or manufactured separately and affixed by suitable means, such as welding. As with other components of the present invention, pin 45 may be manufactured from metal, ABS plastic, fiberglass, or some equivalently strong material. As will be appreciated with reference to the following disclosures, the aligning means is not limited to the particular embodiment herein described.

Referring now to FIGS. 3 and 4, means for detachably engaging the present invention to a crossbow include opposing brackets 60A and 60B. Brackets 60A and 60B have identical configurations; each bracket comprising a curvilinear length of metal terminating at one end in a cylindrical sheath 65 and defining at an opposite end a generally flat foot-portion 61. This curvilinear shape also provides an inherent spring-force in each bracket 60A and 60B which resists deformation of the brackets during operation of this invention (i.e., when brackets 60A and 60B are subject to stress imparted by the bow string during drawing). As shown in FIG. 4, brackets 60A and 60B are oriented such that their curved portions are opposed, with each curve opening away from the barrel 110 of the crossbow. In assembly, each bracket 60A and 60B is mated to one of crossbow limbs 105. (FIG. 4.) Commonly, these limbs 105 are already detachably mounted to the crossbow riser 111 by means of bolts 106. Each foot portion 61 therefore preferably includes correspondingly spaced bores 62 for receiving bolts 106. It will be appreciated that the distance between each bracket 60A and 60B, when assembled to the crossbow, must be similar to the pre-existing distance between each of the crossbow limbs 105, in order to avoid interference with the firing of a bolt. For purposes of interconnecting device 10 with brackets 60A and 60B, each sheath 65 includes a vertically oriented bore 66 therethrough which snugly receives one of pins 24 projecting from housing 20.

Figure 5B:
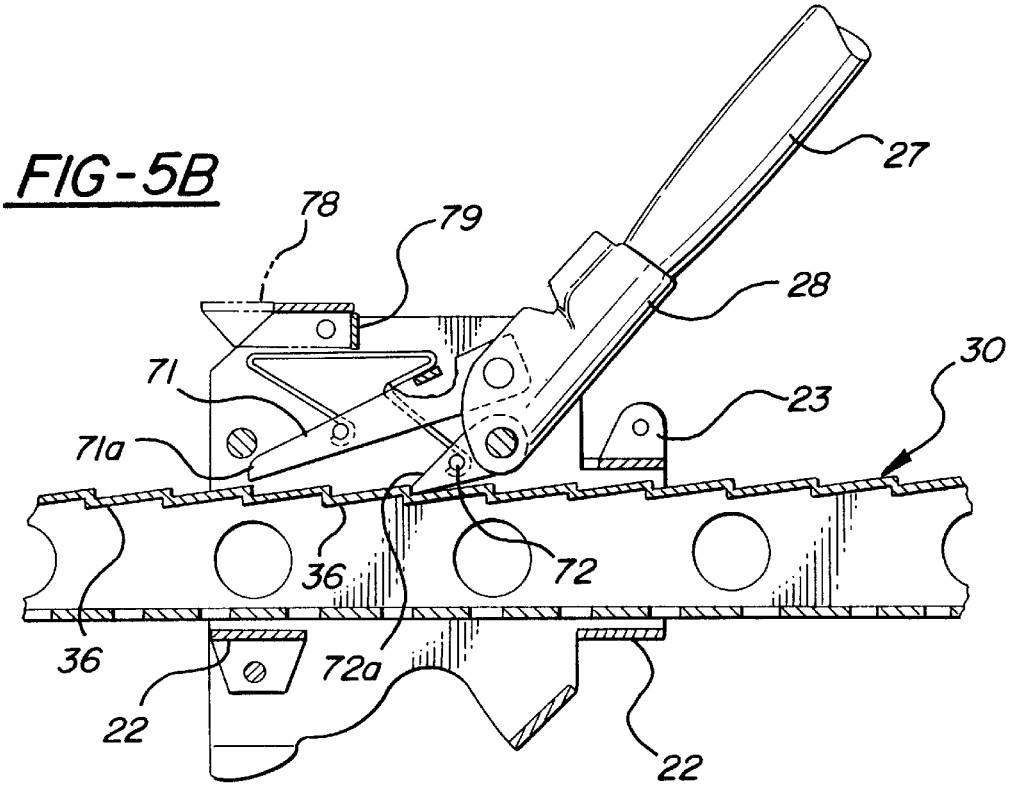
FIG. 5B is a lateral cross-section detailing the rearward drive mechanism of the present invention.

Turning now to FIGS. 5A and 5B, the drive mechanism of the present invention preferably comprises ratchet means such as may be found in a typical automobile jack. The operation of such ratchet means is well known to include leading 71 and trailing 72 pawls independently pivotally connected to base portion 28 of hand lever 27. Pawls 71 and 72 are further interconnected by a ratchet spring 75. At one end of both pawls 71 and 72 are provided tips 71*a* and 72*a*, respectively, which tips are engageable with any of the teeth 36. The drive mechanism is preferably selectively adjustable, providing for both the forward and rearward rectilinear movement of arm 30. To this end, direction control lever 78, pivotally attached to housing 20, is selectively positionable between a first "forward" orientation (FIG. 5A) and a second "reverse" orientation (FIG. 5B) controlling of the direction of movement of arm 30. Direction control lever 78 includes a plate 79 extending perpendicularly therefrom, which plate is engageable with upper region 76 of ratchet spring 75 when control lever 78 is in the "forward" orientation. As shown in FIG. 5A, when direction control lever 78 is in the "forward" orientation, plate 79 applies downward force on upper region 76 of ratchet spring 75; thereby placing spring 75 in a condition of tension. Consequently, both pawls 71 and 72 are urged towards constant engagement with teeth 36. Referring now to the illustrations in FIGS. 5A and 5B depicting in phantom lines both pawls 71 and 72, as well as hand lever 27, it will be seen that when hand lever 27 is operated, each pawl 71 and 72 will engage only the next most rearward tooth. On the other hand, when direction control lever 78 is disposed in the "rearward" orientation, ratchet spring 75 is relaxed and, correspondingly, leading pawl 71 is not urged towards engagement with teeth 36. As a result, operation of hand lever 27 causes each pawl 71 and 72 to engage the next most forward tooth 36.

Still referring to FIGS. 5A and 5B, teeth 36 according to the preferred embodiment are recessed and oriented perpendicular to to the longitudinal axis of arm 30 so as to define grooves therebetween. Teeth 36, shown in cross-section, are arranged seriatim; each successive groove defining both a sloped transitional surface 37 and a vertically-oriented surface 38. As will be appreciated from the drawings, vertical surface 38 securely confronts tips 71*a* and 72*a* of both leading 71 and trailing 72 pawls, thereby preventing the forcible movement of arm 30 in an undesired direction as the bow string is moved into the drawn position. Relatedly, transitional surface 37 facilitates movement of each pawl 71 and 72 towards the next successive groove as the arm is moved in either direction. Alternately, however, teeth 36 may comprise any of a number of configurations known to those of skill in the art. For example, teeth 36 may be raised, rather than recessed, with respect to upper surface 32 of arm 30.

Of course, it will be understood that the drive mechanism of this invention need not comprise a ratchet system identical to that disclosed, and a number of alternate means apparent to those skilled in the art will provide a similar hand-operable mechanical advantage without departing from the broader aspects of this invention.

Figure 6A:
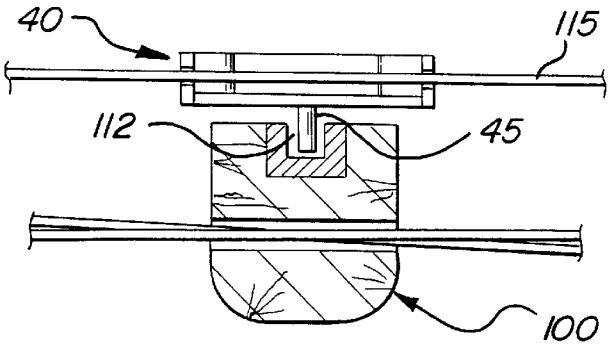
FIG. 6A is a cross-sectional view of the present invention shown in FIG. 6.
Figure 6:
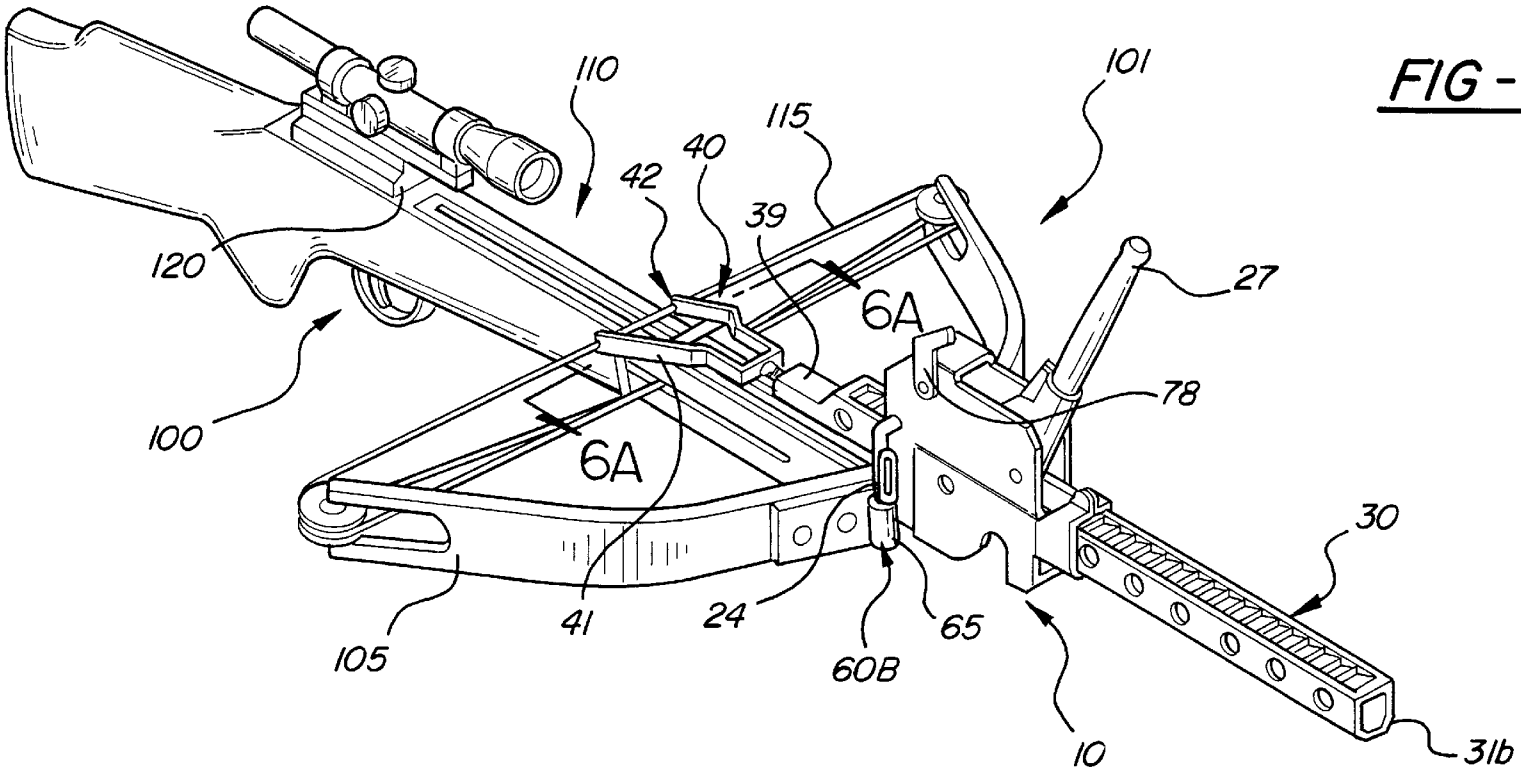
FIG. 6 is a perspective view of the present invention shown in functional engagement with a crossbow.
Figure 7:
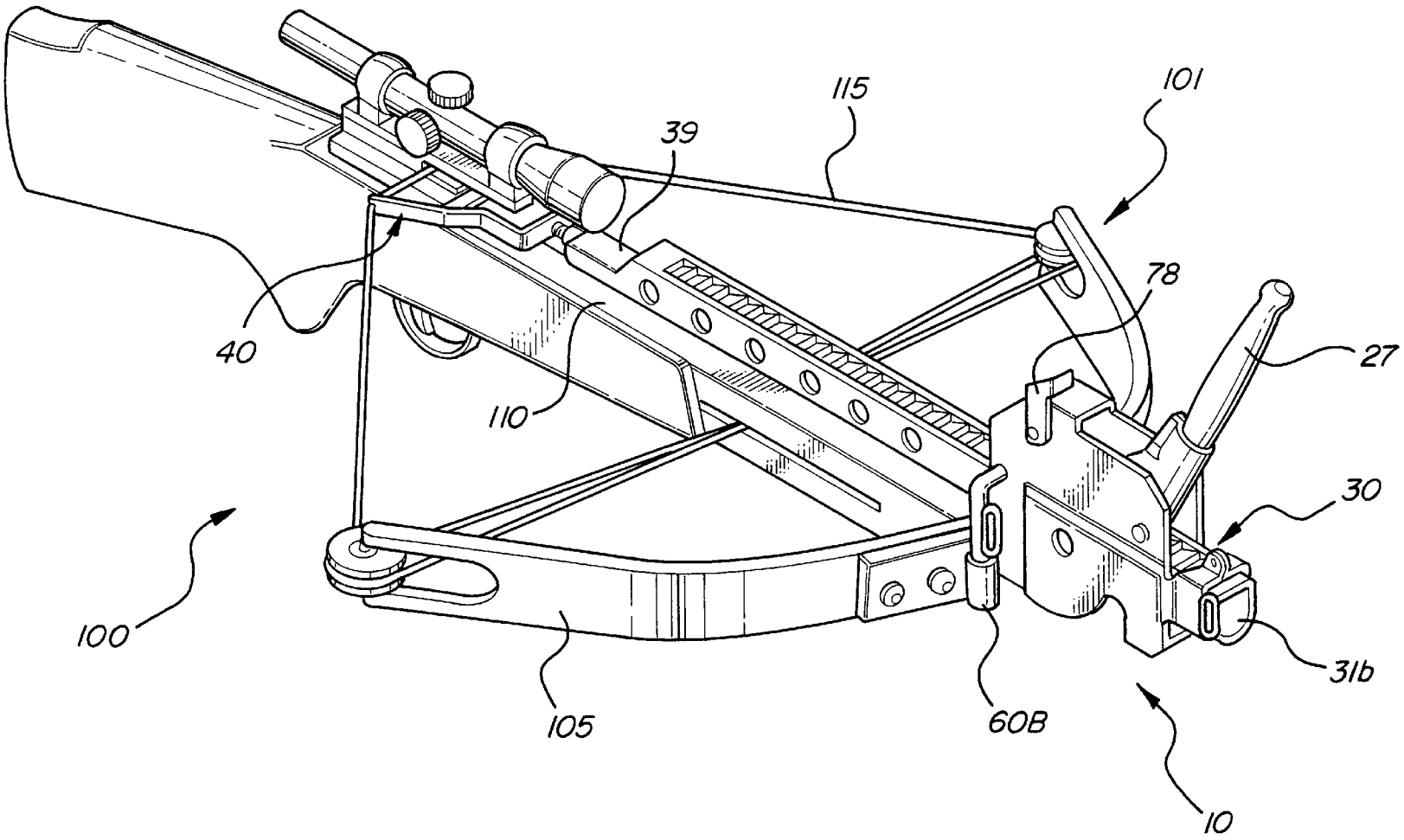
FIG. 7 is a perspective view of the present invention shown in functional engagement with a crossbow wherein the bow string is in the drawn position.

With reference now to FIGS. 6 through 7, operation of the present invention will be better understood. According to use of brackets 60A and 60B as disclosed herein, device 10 is securely attached to the forward end 101 of a crossbow 100 by means of pins 24, each of which are positioned within one of the sheaths 65, such that notches 42 on fork 40 lie in approximately the same plane as bow string 115 and pin 45 is slidingly received within track 112. (FIG. 6A.) The device 10 should be oriented such that operating hand lever 27 in the "forward" drive position (as explained) will cause extension of arm 30 towards the crossbow. By repeated operation of hand lever 27, the ratchet means of the drive mechanism causes arm 30 to move towards the crossbow along the longitudinal axis of barrel 110. As this occurs, notches 42 on fork 40 capture bow string 115, retaining it in place until bow string 115 is forced into the drawn position. Simultaneously, pin 45 prevents unwanted lateral movement of arm 30, thereby eliminating the development of unequal tension in the bow string 115 on either side of barrel 110. Because of the fact that crossbows of various manufacture are characterized by tracks 112 of different depths, it is anticipated that pin 45 may be of any length sufficient to be slidingly received in track 112 and prevent unwanted lateral movement of arm 30 during operation of the present invention. Referring now to FIG. 7, operation of hand lever 27 continues until bow string 105 is in the fully drawn position and is engaged by the cocking mechanism 120 on the bow. According to the most preferred form of this invention, tines 41 are sufficiently long such that they activate the crossbow's safety switch (not shown) as the bow string is engaged by cocking mechanism 120. Because of the "U"-shaped configuration of fork 40, it will be appreciated that the present invention does not interfere with the operation of cocking mechanism 120. Similarly, it will be noted that cut-out portion 39 at first end 31*a* of arm 30 permits operation of device 10 with crossbows having telescopic sights or other hardware mounted thereon, without arm 30 interfering therewith.

As previously set forth, fork 40 is preferably extendably disposed within arm 30, and is further selectively longitudinally extendable with respect thereto. By selectively adjusting the distance from which fork 40 extends from arm 30, the present invention may be configured to accommodate crossbows having different barrel lengths.

In order to release the bow string, the above-described operation is done in reverse. That is, direction control lever 78 is positioned in the "reverse" orientation and hand lever 27 is operated to cause the withdrawal of arm 30 away from cocking mechanism 120, as explained in greater detail elsewhere herein. Of course, great care must be exercised in releasing the bow string after it has been engaged by cocking mechanism 120, since this will require first triggering the crossbow's firing mechanism in order to release the bowstring from the cocking mechanism.

It will be understood that the foregoing is merely illustrative of one embodiment of the present invention. Many modifications and alterations, all apparent to those of ordinary skill in the art, are possible without departing from the spirit and broader aspects of this invention as set forth in the appended claims.

The invention in which an exclusive property or privilege is claimed is defined as follows:

1. In a device to draw the bow string of a crossbow, said device of the type including a housing having an elongate arm extendable from said housing and rectilinearly moveable with respect thereto in at least one direction coaxial with the longitudinal axis of said arm, the improvement comprising:

said arm including means for engaging the crossbow bow string; and a manually operable drive mechanism comprising ratchet means provided in mechanical communication with said arm, such that operation of said drive mechanism effects rectilinear movement of said arm in said at least one direction with respect to said housing.

2. In the device of claim 1, the further improvement wherein said arm includes teeth provided thereon, and said housing includes a hand operated lever provided in mechanical communication with said teeth via said ratchet means.

3. In the device of claim 1, wherein the crossbow is of the type including a longitudinal barrel having a recessed track therein, the further improvement wherein said arm further includes aligning means slidingly receivable within the track of the crossbow such that the path of travel of said arm is substantially parallel to the longitudinal axis of the track.

4. In the device of claim 3, the further improvement wherein said means for engaging the crossbow low string comprise a fork having spaced apart tines, and a reinforcing bar securely retaining said tines in a fixed position with respect to each other.

5. In the device of claim 4, the further improvement wherein said aligning means comprise a pin projecting from said reinforcing bar.

6. A device to draw the bow string of a crossbow of the type including a longitudinal barrel having recessed track therein, said device comprising:

a housing; and an elongate arm extendable from said housing and rectilinearly moveable with respect thereto in at least one direction coaxial with respect to the longitudinal axis of said arm, said arm including means for engaging the crossbow bow string, and aligning means slidingly receivable within the track such that the path of travel of said arm is substantially parallel to the longitudinal axis of the track.

7. In the device of claim 6, wherein said aligning means comprise a pin.

8. In the device of claim 7, wherein said means for engaging the crossbow bow string comprise a fork having spaced-apart tines, and a reinforcing bar securely retaining said tines in a fixed position with respect to each other.

9. In the device of claim 8, wherein said pin projects from said reinforcing bar.

10. In a device to draw the bow string of a crossbow, said device of the type including a housing having an elongate arm extendable from said housing and rectilinearly moveable with respect thereto in at least one direction coaxial with the longitudinal axis of said arm, the improvement comprising:

said housing including a hand operated lever provided thereon; said arm including teeth thereon and having first and second ends, one of said first or second ends being provided with means for engaging the crossbow bow string; and a drive mechanism by which said lever is provided in mechanical communication with said teeth, such that operation of said drive mechanism effects rectilinear movement of said arm in said at least one direction with respect to said housing and the crossbow bow string is engaged by said means for engaging the crossbow bow string and carried in the direction of movement of said arm.

11. In the device of claim 10, the further improvement wherein said drive mechanism is selectively adjustable such that said arm is rectilinearly movable in two directions with respect to said housing.

12. In the device of claim 10, wherein the crossbow is of the type including a longitudinal barrel having a recessed track therein, the further improvement wherein said arm further includes aligning means slidingly receivable within the track of the crossbow such that the path of travel of said arm is substantially parallel to the longitudinal axis of the track.

13. In the device of claim 12, the further improvement wherein said aligning means comprise a pin.

14. In the device of claim 13, the further improvement wherein said means for engaging the crossbow bow string comprise a fork opening towards the crossbow bow string and having spaced-apart tines, said fork further including a reinforcing bar securely retaining said tines in a fixed position with respect to each other.

15. In the device of claim 14, the further improvement wherein said pin projects from said reinforcing bar.

16. In a manually operated device to draw the bow string of a crossbow, said device of the type including a housing having an elongate arm extendable from said housing and rectilinearly moveable with respect thereto in at least one direction coaxial with the longitudinal axis of said arm, the improvement comprising:

said housing including a manually operable lever provided thereon; said arm having first and second ends and a plurality of teeth provided thereon, said arm further including means provided at said first end thereof for engaging the crossbow string; and a drive mechanism by which said lever is provided in mechanical communication with said teeth, such that operation of said lever effects rectilinear movement of said arm in said at least one direction with respect to said housing.

17. In the device of claim 16, the further improvement wherein said means for engaging the crossbow bow string comprise a fork opening towards the crossbow string and having spaced-apart tines, said fork further including a reinforcing bar securely retaining said tines in a fixed position with respect to each other.

18. In the device of claim 17, the further improvement wherein said arm further includes at least an upper surface, and said first end of said arm includes a cut-out portion, said cut-out portion oriented towards both said first end and said upper surface of said arm.

19. In the device of claim 18, the further improvement wherein said fork is further selectively longitudinally extendable and longitudinally retractable with respect to said arm.

20. In the device of claim 19, the further improvement wherein said drive mechanism comprises ratchet means.

21. In the device of claim 20, the further improvement wherein said arm further includes opposing lateral sides and a lower surface, said opposing lateral sides and said lower surface each having a plurality of holes therein.

22. In the device of claim 21, the further improvement wherein said drive mechanism is selectively adjustable such that said arm is rectilinearly movable in two directions with respect to said housing.

23. In the device of claim 22, the further improvement wherein said teeth are recessed to define grooves arranged seriatim on said upper surface of said arm.

24. In the device of claim 23, wherein the crossbow is of the type including a longitudinal barrel having a recessed track therein, the further improvement wherein said arm further includes aligning means slidingly receivable within the track of the crossbow such that the path of travel of said arm is substantially parallel to the longitudinal axis of the track.

25. In the device of claim 24 the further improvement wherein said aligning means comprise a pin.

26. In the device of claim 25, the further improvement wherein said pin projects from said reinforcing bar.

27. A manually operated device to draw the bow string of a crossbow, comprising:

a housing removably engageable with the forward end of the crossbow, said housing including a hand operated lever pivotally disposed thereon;

an elongate arm extending through said housing and being rectilinearly movable with respect thereto in two directions coaxial with the longitudinal axis of said arm, said arm having first and second ends and at least upper and lower surfaces, at least one of said upper and lower surfaces having a plurality of teeth provided thereon, said arm further including means provided at said first end thereof for engaging the crossbow bow string, said means comprising a fork opening towards the crossbow bow string and having spaced-apart tines, each said tine including a notch therein opening towards the crossbow bow string, said fork further including a reinforcing bar securely retaining said tines in a fixed position with respect to each other; and a drive mechanism comprising ratchet means provided in said housing, said hand lever and said teeth being in mechanical communication via said drive mechanism such that pivotal movement of said hand lever results in rectilinear movement of said arm, wherein further said drive mechanism is selectively adjustable such that said rectilinear movement of said arm may be effected in either of said two directions with respect to said housing.

28. A manually operated device to draw the bow string of a crossbow of the type including a longitudinal barrel having a recessed track therein, said device comprising:

a housing including a hand lever pivotally disposed thereon;

an elongate arm extendable from said housing and rectilinearly movable with respect thereto in two directions coaxial with the longitudinal axis of said arm, said arm having first and second ends and including a plurality of teeth, said arm further including means provided at said first end thereof for engaging the crossbow bow string, said means comprising a fork opening towards the crossbow bow string and having spaced-apart tines, each said tine including a notch therein opening towards the crossbow bow string, said fork further including a reinforcing bar securely retaining said tines in a fixed position with respect to each other, and wherein said arm further includes aligning means slidingly receivable within the track such that the path of travel of said arm is substantially parallel to the longitudinal axis of the track, said aligning means comprising a pin projecting from said reinforcing bar; and a drive mechanism comprising ratchet means, said hand lever and said teeth being in mechanical communication via said drive mechanism such that pivotal movement of said hand lever results in rectilinear movement of said arm.

* * * * *